US005948354A

United States Patent [19]

Odin et al.

[11] Patent Number: 5,948,354

[45] Date of Patent: Sep. 7, 1999

[54] FERRULES FOR CONTINUOUS CASTINGS OF METAL OR METAL ALLOY, IN PARTICULAR ALUMINUM

[75] Inventors: Georges Odin, Unieux; Gérard Vidalenc, Saint Victor Sur Loire; Maxime Laugier, Montigny Les Metz, all of France

[73] Assignee: Forcast International, Nanterre, France

[21] Appl. No.: 09/015,778

[22] Filed: Jan. 29, 1998

[30] Foreign Application Priority Data

Jan. 29, 1997 [FR] France ..... 97 00918

[51] Int. Cl.[6] ..... C22C 38/22; C22C 38/44

[52] U.S. Cl. ..... 420/109; 420/111

[58] Field of Search ..... 420/109, 111; 148/334, 335

[56] References Cited

U.S. PATENT DOCUMENTS 5,599,497 2/1997 Cordea et al. ..... 420/109

FOREIGN PATENT DOCUMENTS 2 578 768 9/1986 France .

OTHER PUBLICATIONS

C.W. Wegst: "Stahlschlüssel", Verlag Stahlschlüssel Wegst GMBH, Marbach XP002042355, Nov. 5, 1984.

*Primary Examiner*—Deborah Yee

*Attorney, Agent, or Firm*—Oblon, Spivak, McClelland, Maier & Neustadt, P.C.

[57] ABSTRACT

Cylinder ferrule for continuous casting of metal or metal alloy, in particular aluminum, characterized in that it is made of a steel the composition of which, in percentage by weight, is the following:

Carbon: 0.25 to 0.35%

Manganese: 0.30 to 0.60%

Silicon: 0.15 to 0.45%

Nickel: below 0.40%

Chromium: 2.90 to 3.5%

Molybdenum: 2.5 to 3.1%

Vanadium: 0.3 to 0.70%

Sulfur: ≦0.020%

Phosphorus: ≦0.020%

Copper: ≦1% the remainder being essentially iron and residual impurities.

5 Claims, 2 Drawing Sheets

FERRULES FOR CONTINUOUS CASTINGS OF METAL OR METAL ALLOY, IN PARTICULAR ALUMINUM

BACKGROUND OF THE INVENTION

1. Field of the Invention

The invention relates to a steel particularly useful for cylinder ferrules for continuous casting of aluminum having, with respect to the steels currently known, an improved life span without any deterioration in the productivity of the installation.

2. Discussion of the Background

The continuous-casting machines for aluminum, or aluminum alloys, consist of two rotating cylinders between which the liquid metal is introduced. In certain recent installations, these two cylinders rest on two larger support cylinders. The cylinders in contact with the liquid metal are designed to solidify the latter and form a sheet metal which in addition undergoes or may undergo a hot-rolling making it possible to obtain it in the form of a coil. For this purpose, the cylinders are made up of a central portion (core) bearing cooling circuits and a ferrule mounted on the core by binding or any other means.

The inner surface of the ferrule is cooled by the water circulating in cooling tubes borne by the core. The primary role of the ferrule thus is to extract the calories from the liquid aluminum to make possible the solidification thereof prior to release from control between the cylinders.

The ferrule, cooled internally, thus constitutes a heat exchanger with the liquid aluminum. The productivity of the installation depends directly on the power of this exchanger.

The ferrule furthermore is subjected to intense thermo-mechanical actions due to thermal cycling and to constraints of mechanical origin: mounting constraints, in particular from binding resulting from the design of the cylinders—bending and torsion constraints due to operating stress. These actions lead to a surface plastic fatigue, the initiation and the spreading of networks of microfissures, which necessitate a periodic reconditioning of the ferrule, by machining. The life span of a ferrule thus depends essentially on its capacity to withstand thermal actions.

A steel for a continuous-casting ferrule therefore should possess both:

good heat-exchange capacity with liquid aluminum in order to ensure high productivity of the installation, and good resistance to thermal fatigue in order to provide a long life span for the ferrules.

Up to the present:

the heat exchange capacity has been linked essentially to the thermal conductivity of the variation at ambient temperature, the resistance to thermal fatigue has been linked to the mechanical and physical characteristics at ambient temperature or when heated (Limit of elasticity, Young Model, coefficient of dilatation . . . ) or, more precisely, has been measured in simulation tests.

Generally speaking, the addition of alloy elements Cr, Mo, V, improves the capacity to withstand thermal fatigue but degrades thermal conductivity at ambient temperature.

The search for variations suitable for the manufacture of ferrules thus has been confined, up to the present, to that for a conductivity/thermal fatigue compromise by optimal adjustment of the ratios among the various alloy elements and by restriction to relatively scantly alloyed variations.

It is thus that the steels disclosed in the patent U.S. Pat. No. 4,409,027 (incorporated herein by reference) are known, containing in their composition:

0.5 to 0.6% carbon
0.4 to 1% manganese
0.1 to 0.3% silicon
0.4 to 0.9% nickel
1.5 to 3% chromium
0.8 to 1.2% molybdenum
0.3 to 0.5% vanadium, and those in the patent FR 2,567,910 (incorporated herein by reference) containing:

0.30 to 0.65% carbon
Max. 0.80% manganese
Max. 0.80% silicon
2 to 4.5% chromium
0.4 to 0.8% molybdenum
0.1 to 0.3% vanadium The patent U.S. Pat. No. 4,861,549 (incorporated herein by reference) recommends additions of rare earths in the basic compositions, as for example:

0.45 to 0.49% carbon
0.90 to 1.00% manganese
0.15 to 0.35% silicon
1.2 to 1.5 nickel
1.2 to 1.45% chromium
0.8 to 1.0% molybdenum
0.15 to 0.20% vanadium
0.08% max. rare earths The best compromise appears to be provided by the variation of the ferrule in the patent application FR 85,03,867 (incorporated herein by reference), the composition of which is the following:

0.30 to 0.36% carbon
0.30 to 0.60% manganese
0.15 to 0.45% silicon
Max. 0.40% nickel
2.80 to 3.40% chromium
0.85 to 1.25% molybdenum
0.10 to 0.30% vanadium It will be noted that none of these current state-of-the-art compositions combines chromium with another alloy element in a percentage in excess of 1.5%, for fear of a reduction in thermal conductivity.

OBJECTS AND SUMMARY OF THE INVENTION

One object of the invention is to provide a new ferrule for continuous casting of aluminum which ensures a high productivity of the installation similar to those of the ferrules currently used, with a duration of operation superior to those of the best current products, with the aid of the use of a steel combining Cr and Mo in high percentages.

The preferred embodiment of this invention is a cylinder ferrule for continuous casting of metal or metal alloy, in particular aluminum, characterized in that it is made of a steel the composition of which, in percentage by weight, is the following:

C 0.25 to 0.35%—Mn 0.30 to 0.60%—Si 0.15 to 0.45%—Ni below 0.40%—Cr 2.90 to 3.5%—Mo 2.5 to 3.1%—V 0.3 to 0.70%—S≦0.020%—P≦0.020%—Cu 0.1 to 0.5%, the remainder being essentially iron and residual impurities.

According to a preferred mode of this embodiment, the composition of the steel is the following:

C 0.28 to 0.32%—Mn 0.30 to 0.50%—Si 0.15 to 0.35%—Ni below 0.25%—Cr 3.0 to 3.2%—Mo 2.7 to 2.9%—V 0.45 to 0.55%—S≦0.015%—P≦0.020%—Cu 0.1 to 0.5%, the remainder being essentially iron and residual impurities.

The steels described above also make up an embodiment of the invention.

The description which follows and the accompanying figures, all given by way of nonlimitative example, will make the invention clearly understood.

DETAILED DESCRIPTION OF THE INVENTION

Figure 1:
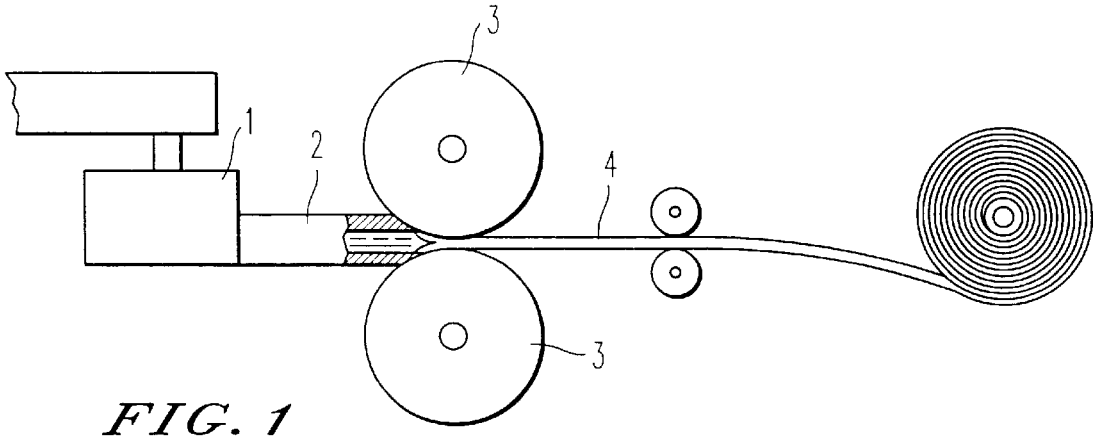
FIG. 1 is a diagrammatic view of a horizontal continuous-casting installation.
Figure 2:
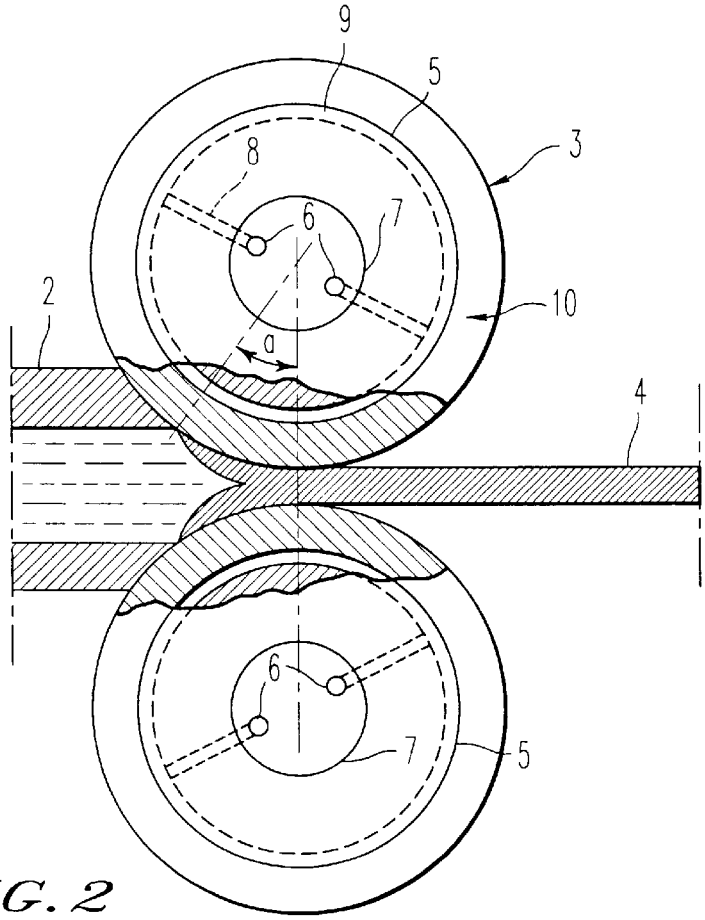
FIG. 2 is a diagrammatic lateral vertical partial section of a portion of the installation of FIG. 1.

The principle of light-alloy continuous casting represented in FIGS. 1 and 2 relates to the so-called horizontal 2-cylinder casting. Aluminum, an aluminum alloy, copper, a copper alloy, melted down in a kiln which is not represented, is maintained at a constant level in a conduit 1 and introduced, by means of a base 2, between two cylinders 3, at a temperature close to the melting temperature, and on the order of 680° C. for aluminum. The cylinders 3 are drawn in rotation in opposite directions with a spacing which determines the thickness of the solidified sheet 4. The latter may vary between 12 mm and 2 mm in the most recent installations. The laminating control constitutes a continuous ingot mold in which, on contact with the cooled cylinders, the aluminum is solidified while it is drawn along by rotation of the cylinders.

Each cylinder has a cooling circuit traversed by a fluid, generally water. Each cylinder is made in 2 parts, namely:

a core 5 which is a steel cylinder in which are arranged the longitudinal conduits 6, for conveyance and exit of water by means of the journals 7. These conduits feed, by means of radial conduits 8, peripheral grooves 9 bringing the ferrule 10 into direct contact with the cooling fluid. This ferrule constitutes the consumable portion of the cylinder. Its primary role is to extract the calories from the alloy under solidification. It is understood that the productivity of the casting machine is linked directly to the calorie-transfer capacity through the ferrule.

In addition, the ferrule undergoes intense thermomechanical action. The constraint condition at each point of the ferrules is defined by the multitude of constraints of mechanical origin and constraints of thermal origin due to thermal cycling.

The mechanical constraints derive from:

binding (static constraints)

the drive torque which induces torsion-shear constraints the laminating pressure which brings about cylinder bending and a distribution of shear compression constraints in the cylinder control.

Each rotation of the cylinder brings its skin into contact with the liquid metal, in the contact arc "a" (FIG. 2). A thermal gradient in the thickness of the ferrule results therefrom. Then on coming out of contact, the rotation allows the area acted upon to cool.

Figure 3:
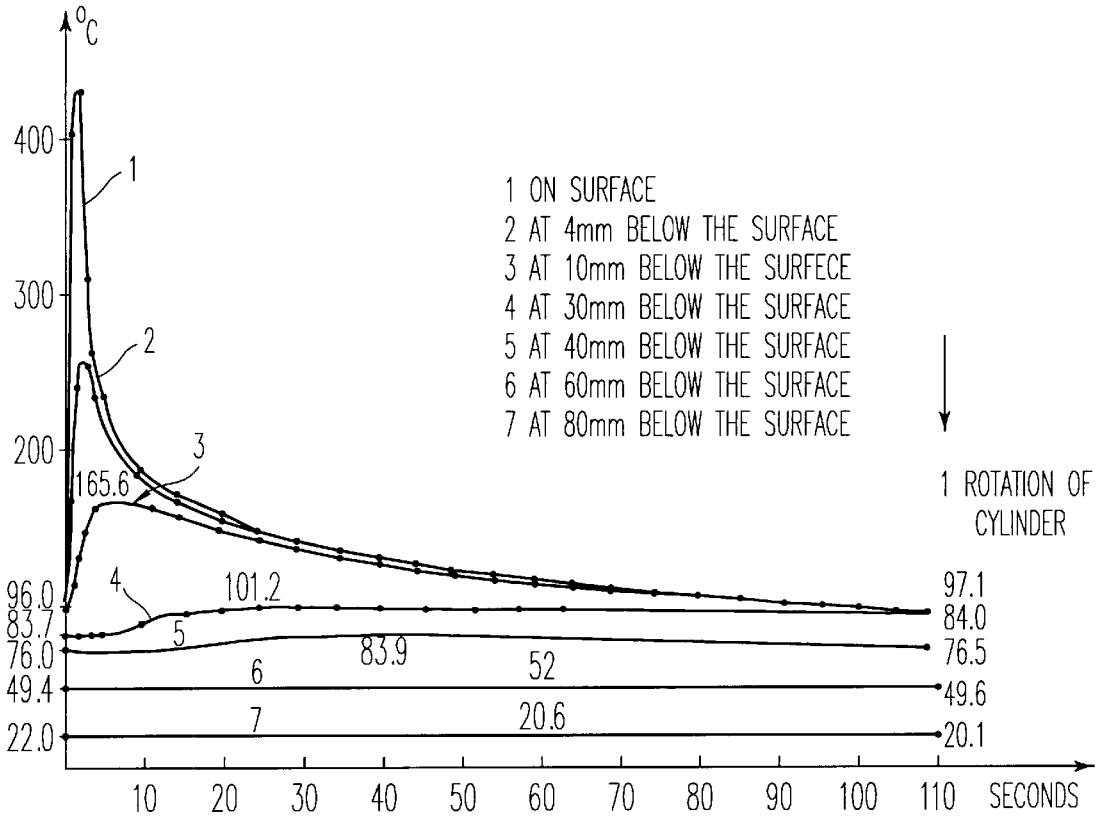
FIG. 3 shows the temperatures measured at different points on the section of a ferrule during operation.

The thermal evolution has been studied by means of temperature measurements in the thickness of the ferrule. FIG. 3 shows, by way of example, one of these readings over the duration of a cylinder rotation. The results of this study prompted the definition of the thermal cycle assigned to the ferrule steel in the thermal-fatigue resistance test which is described below and used in this description.

Each cycle induces in the skin of the ferrule a maximal compression constraint the level of which exceeds the limit of elasticity of the steel. A plastic compression deformation of the skin results therefrom.

Figure 4:
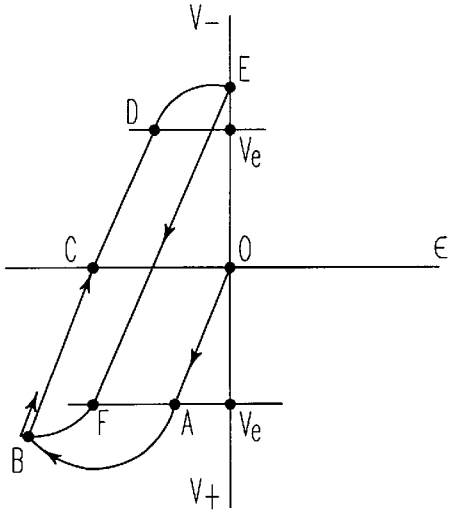
FIG. 4 is a diagram illustrating the cycle of constraints in terms of the elongation undergone by the metal in the ferrule.

The cycle of constraints is illustrated in FIG. 4. The initial heating is represented by the line OA, then the curve AB, which corresponds to the plastic deformation on the deformation constraints diagram of FIG. 4.

On cooling, the deformation is going to tend to cancel out, but the metal will not be able to resume its position elastically, since in heating it has undergone a plastic compression deformation. The return to the low temperature is going to cause, in D, the exceeding of the limit of elasticity in tension and bring about a plastic deformation, this time in tension, up to point E. Each new thermal cycle will bring about, following the EFBD route, a plastic deformation "FB" on heating a plastic deformation "DE" on cooling.

This cycle of deformations of thermal origin inevitably generates a surface mechanical fatigue which is expressed by the initiation, then the spreading of microfissures: it is the so-called thermal fatigue phenomenon.

Up to the present, the study of steels suitable for the manufacture of ferrules for continuous casting of aluminum has been conducted as the search for a better possible compromise between:

thermal conductivity in order to obtain a good heat transfer capacity for the ferrule and resistance to thermal fatigue The latter depends on the mechanical characteristics, in particular the limit of elasticity when heated, the Young model, the coefficient of dilatation.

The effect on steel of chromium, of molybdenum which drives back the softening temperatures, of vanadium which raises the characteristics when heated, the effect of carbon which, by precipitating the carbides formed with the preceding elements, is going to harden the steel, are known. It is known how to use elements such as Nickel, Manganese, Silicon in order to provide steel with a homogeneous, stable structure with good toughness. Also known are the unfavorable effects of certain residual S, P, etc. But it is also known that all these alloy elements have an unfavorable effect on thermal conductivity at ambient temperature.

The search for a steel composition optimized for continuous-casting ferrules therefore has consisted essentially in using the alloy elements in the optimal way with a view to obtaining the best resistance with a thermal conductivity scarcely changed with respect to the scantly alloyed steels initially used for this application.

The inventors have demonstrated that this approach was too schematic, considering the large number of parameters involved and especially their interdependence. As regards the productivity of the installation, this depends, for example, not only on the thermal conductivity of the ferrule but also the diffisivity, the specific heat, the voluminal mass, the interface transfer coefficients, the contact arc, the geometry of the ferrule, the tribologic properties, and the kinetics of solidification in the contact arc. And, of course, the mechanical and physical characteristics of the ferrule material vary, in terms of the thermal gradient, in the thickness of the ferrule between the outer layers in contact with the liquid aluminum and the inner layers in contact with the water.

This invention results from work which has shown that the heat-transfer capacity of the ferrule depended not only on the thermal conductivity of the material at ambient temperature, but on numerous other parameters such as the diffusivity D, the specific heat Cp, the voluminal mass p. In addition, it is essentially the values attained by these parameters in the superficial layers of the ferrule, in contact with the liquid aluminum and brought to temperatures on the order of 600° C., which have a preponderant effect on the heat-exchange capacity of the ferrule.

Through a surprising effect, steels combining substantial additions of Mo (approximately 3%) with that of Cr and V, thus have a favorable evolution of the characteristics of conductivity, diffusivity, specific heat, voluminal mass, at temperatures reached in the outer layers of the ferrule. Therefore this allows them installation-productivity heat-transfer capacities identical to that of existing steels, despite a lower thermal conductivity at ambient temperature. Furthermore, these steels with 3% Mo+3% Cr and V have a resistance to thermal fatigue, therefore a ferrule life span, very greatly improved with respect to that of the steels currently used, clearly superior, to a surprising extent, to what the increase in the alloy elements might allow us to expect.

The element copper affects the oxidability of the steel in the ferrule; the chromium, molybdenum, vanadium, carbide-producing substances, which precipitate in combination with carbon, affect hardness under hot and cold conditions. Molybdenum drives back the softening temperature for the steel and vanadium raises the characteristics when heated.

Only a thermomechanical simulation model with finished elements makes it possible to give proper consideration to the totality of the phenomena and the parameters which act on a continuous-casting ferrule in the course of operation. This project was carried out by the inventors. Operating conditions are introduced through limit conditions. The rotation of the ferrule is simulated by modifying the limit conditions of the different links, in terms of two angular parameters:

for movement of the contact arc for variation of the ferrule aluminum transfer coefficient inside the contact arc.

It may be considered that the cyclic thermal condition is the overlaying of a transient condition and a permanent thermal condition, the exchanges with the ambient air being disregarded.

The model makes it possible to calculate the temperature "chart" of the ferrule with an excellent approximation with respect to the experimental measurement. The agreement between calculated values and experimental values likewise is very good with respect to the heating power of the exchanger, the heating rate of the outer layers in the contact arc, the thermal gradient in the ferrule. The heating power of the exchanger is representative of the productivity of the installation. The heating rate and the thermal gradient are significant parameters for thermal fatigue.

Tests have been conducted for different ferrule steels for comparison of tests for thermal-fatigue resistance on a specific device described below. This device comprises a finely adjusted cylindrical test-piece which is intermittently heated on the surface through high-frequency induction and which is cooled internally by circulation of water in an ongoing manner.

The definition of the test-piece, the generator power, the self-test-piece connection, the cooling made it possible to define a thermal cycle very representative of the actual thermal cycle undergone by the outer layers of the ferrule, as it is known through temperature measurements recorded on actual operating ferrules, and through the thermomechanical model described above. The criterion adopted is the count and the depth of the fissures observed, after a given number of cycles, on a section of test-piece for 10 linear mm on the surface. Preliminary tests showed an excellent correlation between the results of this test and those of actual ferrules in service.

Among the different variations studied, a variation quite highly alloyed with Cr, Mo and V showed, with a surprising effect:

a very favorable evolution of thermal characteristics in terms of temperature, with respect to the steels currently used, making it possible to obtain an exchange heating power identical to that of the current variations, despite a low heat conductivity at ambient temperature;

a very significant improvement in resistance to thermal fatigue; as a matter of fact, under tests condition where fissure depths of 100 $\mu$m to 400 $\mu$m are obtained on the best current steels, no fissure in excess of 20 $\mu$m was observed on this new variation.

Detailed results are indicated below.

The ferrules for continuous casting according to this invention are made from a variation of steel prepared in an electric furnace, ladle-cast under vacuum, where it is refined and degassed, then finally cast in an ingot mold. The ingots obtained are heated to approximately 1200° C., heat-perforated to obtain rough-forged pieces which are themselves forged in tubes from 400 mm to 1300 mm in diameter in terms of the final dimensions of the ferrule to be obtained. These rough-forged pieces then are annealed, machined, then hardened (austenization 1030° C.) and tempered to obtain the required metallurgical grade.

Table I below indicates the compositions by weight of the various steels subjected to the test, for purposes of comparison.

TABLE I

| | COMPOSITION IN PERCENTAGE BY WEIGHT | | | | | | | | | |
|---|---|---|---|---|---|---|---|---|---|---|
| VARIATION | C | MN | Si | S | P | Ni | Cr | Mo | V | Other |
| 1 Prior technique | 0.32 | 0.50 | 0.35 | 0.003 | 0.018 | 0.15 | 3.15 | 0.95 | 0.20 | |
| 2 Prior technique | 0.34 | 0.35 | 0.30 | 0.002 | 0.010 | 0.20 | 3.0 | 1.05 | 0.18 | |
| 3 Invention | 0.29 | 0.3 | 0.20 | 0.005 | 0.010 | 0.20 | 3.1 | 2.9 | 0.55 | Cu |

TABLE I-continued

| VARIATION | COMPOSITION IN PERCENTAGE BY WEIGHT C | MN | Si | S | P | Ni | Cr | Mo | V | Other |
|---|---|---|---|---|---|---|---|---|---|---|
| 4 Invention | 0.31 | 0.35 | 0.25 | 0.003 | 0.015 | 0.25 | 3.0 | 2.8 | 0.45 | 0.34 Cu 0.37 |

Table II presents the results of mechanical-tension tests conducted at ambient temperature 430° C.–530° C.–630° C.

TABLE II

| | MECHANICAL CHARACTERISTICS - TENSION TEST | | | | | | | | | | | |
|---|---|---|---|---|---|---|---|---|---|---|---|---|
| | At 20° C. | | | At 430° C. | | | At 530° C. | | | At 630° C. | | |
| | Rm Mpa | R0.02 Mpa | A % | Rm Mpa | R0.02 Mpa | A % | Rm Mpa | R0.02 Mpa | A % | Rm Mpa | R0.02 Mpa | A % |
| 1 Prior Technique | 1310 | 1140 | 17 | 1012 | 863 | 14 | 881 | 797 | 17 | 550 | 430 | 18 |
| 2 Prior Technique | 1315 | 1130 | 16 | 1015 | 860 | 13 | 890 | 790 | 17 | 560 | 435 | 16.5 |
| 3 Invention | 1386 | 1247 | 6.5 | 1095 | 1003 | 7.5 | 1018 | 884 | 9 | 762 | 690 | 9 |
| 4 Invention | 1370 | 1230 | 7.5 | 1085 | 992 | 9 | 1007 | 880 | 10 | 750 | 674 | 10 |

Table III indicates the physical characteristics obtained at different temperatures.

TABLE III

| | CHARACTERISTICS | | | | | | | |
|---|---|---|---|---|---|---|---|---|
| | Prior Technique (Mean 1–2) | | | | Invention (Mean 3–4) | | | |
| | Voluminal Mass p ($10^3 \cdot kg \cdot m^{-3}$) | Specific Heat Cp ($10^3 \cdot J \cdot kg^{-1} \cdot {}^\circ C.^{-1}$) | Diffusivity D ($10^{-6} \cdot m^2 \cdot s^{-1}$) | Conductivity K ($W \cdot m^{-1} \cdot {}^\circ C.^{-1}$) | Voluminal Mass p ($10^3 \cdot kg \cdot m^{-3}$) | Specific Heat Cp ($10^3 \cdot J \cdot kg^{-1} \cdot {}^\circ C.^{-1}$) | Diffusivity D ($10^{-6} \cdot m^2 \cdot s^{-1}$) | Conductivity K ($W \cdot m^{-1} \cdot {}^\circ C.^{-1}$) |
| 20 | 7.85 | 0.490 | 9.32 | 35.84 | 7.85 | 0.480 | 8.32 | 31.35 |
| 50 | 7.84 | 0.500 | 9.15 | 35.87 | 7.84 | 0.490 | 8.49 | 32.62 |
| 100 | 7.83 | 0.507 | 8.98 | 35.65 | 7.83 | 0.501 | 8.34 | 32.72 |
| 150 | 7.82 | 0.525 | 8.73 | 35.84 | 7.82 | 0.515 | 8.19 | 32.98 |
| 200 | 7.81 | 0.541 | 8.44 | 35.66 | 7.80 | 0.530 | 7.90 | 32.66 |
| 250 | 7.79 | 0.558 | 8.10 | 35.21 | 7.79 | 0.546 | 7.68 | 32.67 |
| 300 | 7.78 | 0.575 | 7.85 | 35.12 | 7.77 | 0.564 | 7.39 | 32.39 |
| 350 | 7.76 | 0.596 | 7.42 | 34.32 | 7.76 | 0.582 | 7.19 | 32.47 |
| 400 | 7.75 | 0.612 | 7.07 | 33.63 | 7.74 | 0.600 | 7.06 | 32.79 |
| 450 | 7.73 | 0.635 | 6.63 | 32.54 | 7.73 | 0.620 | 6.53 | 31.30 |
| 500 | 7.71 | 0.665 | 6.17 | 31.63 | 7.71 | 0.649 | 6.48 | 32.42 |
| 550 | 7.70 | 0.702 | 5.57 | 30.11 | 7.70 | 0.684 | 6.06 | 31.92 |
| 600 | 7.68 | 0.750 | 5.16 | 29.72 | 7.68 | 0.725 | 5.26 | 30.29 |

It is seen that the steel according to the invention shows a surprising evolution of conductivity and diffusivity in terms of the temperature: clearly below the values measured for the reference steel at ambient temperature, they become equivalent to or even higher than those for the reference steel as soon as the temperature reaches approximately 400° C.

On introducing these values into the thermal model described above, it is seen that the ferrules manufactured with the steel according to the invention have, despite their obviously higher percentage of alloy elements, a thermal exchange capacity identical to that of reference-steel ferrules.

By way of example, Table IV presents the results obtained for ferrules 80 mm in thickness (new) and 30 mm in thickness (regular reject category).

TABLE IV

| Results of thermal simulation | Prior technique | | Steel according to the invention | |
|---|---|---|---|---|
| | New ferrule | Reject | New ferrule | Reject |
| Unchanged power | 323 kw | 367 kw | 315 kw | 364 kw |
| Max. surface temperature | 416° C. | 389° C. | 425° C. | 397° C. |
| Min. surface temperature | 103° C. | 24° C. | 108° C. | 26° C. |
| Surface gradient ° C./mm | 68° C./mm | 76° C./mm | 68° C./mm | 77° C./mm |
| Heating rate ° C./s | 104° C./s | 121° C./s | 106° C./s | 214° C./s |

It is seen that the exchanged powers are identical for the reference and the steel according to the invention in the reject category. They differ by less than 3% in maximum thickness. The machine productivities therefore are extremely close.

The mean temperature of the ferrule according to the invention is slightly higher than that of the reference.

Table V presents the results of thermal-fatigue tests.

TABLE V

| Thermal-fatigue tests - Length of fissures after 3000 cycles | | | |
|---|---|---|---|
| Variations | Cumulative length μm | Mean length μm | Maximum length μm |
| 1 Prior Technique | 425 | 43 | 98 |
| 2 Prior Technique | 1035 | 96 | 371 |
| 3 According to Invention | <50 | <15 | ≦20 |
| 4 According to Invention | <50 | <15 | ≦20 |

It is seen that under the test conditions, the steel according to the invention shows a considerable improvement in the capacity to resist thermal fatigue, quite surprising as it is very superior to that which the increase in the percentage of Mo and the elasticity limit when heated allowed us to expect.

The sensitivity of the test does not make it possible to demonstrate the declines any further.

This improvement in the capacity to resist thermal fatigue, therefore in the life span of the ferrules, with a productivity of the installation similar to that of the best prior variations has been confirmed under industrial conditions.

As noted above, preferred steels according to and useful in the invention comprise iron, residual impurities from smelting, and by weight based on total weight:

Carbon: 0.25 to 0.35%, including 0.28, 0.30, 0.33%

Manganese: 0.30 to 0.60%, including 0.35, 0.40, 0.45, 0.50, 0.55%

Silicon: 0.15 to 0.45%, including 0.20, 0.30, 0.40%

Nickel: below 0.40%, including below 0.30%, below 0.20%

Chromium: 2.90 to 3.5%, including 3.0, 3.3%

Molybdenum: 2.5 to 3.1%, including 2.8, 3.0%

Vanadium: 0.3 to 0.70%, including 0.5, 0.6%

Sulfur: ≦0.020%, including ≦0.010%

Phosphorus: ≦0.020%, including ≦0.010%

Copper: ≦1%, including ≦0.5%.

This application is based on French Patent Application 97,00918 filed Jan. 29, 1997, incorporated herein by reference.

What is claimed as new and is desired to be secured by Letters Patent of the United States is:

1. A cylinder ferrule comprising steel the composition of which, in percentage by weight, is the following:

Carbon: 0.25 to 0.35%

Manganese: 0.30 to 0.60%

Silicon: 0.15 to 0.45%

Nickel: below 0.40%

Chromium: 2.90 to 3.5%

Molybdenum: 2.5 to 3.1%

Vanadium: 0.3 to 0.70%

Sulfur: ≦0.020%

Phosphorus: ≦0.020%

Copper: 0.1–1%, and iron and residual impurities.

2. The ferrule according to claim 1, wherein the steel has a composition as follows:

Carbon: 0.28 to 0.32%

Manganese: 0.30 to 0.50%

Silicon: 0.15 to 0.35%

Nickel: below 0.25%

Chromium: 3.0 to 3.2%

Molybdenum: 2.7 to 2.9%

Vanadium: 0.45 to 0.55%

Sulfur: ≦0.015%

Phosphorus: ≦0.020%

Copper: 0.1 to 0.5% the remainder being essentially iron and residual impurities.

3. The ferrule according to claim 1, comprising 0.1 to 0.5% copper.

4. The ferrule according to claim 1, comprising 0.34–0.37% copper.

5. The ferrule according to claim 2, comprising 0.34–0.37% copper.

* * * * *